US005251731A

United States Patent [19]

Cassese et al.

[11] Patent Number: 5,251,731

[45] Date of Patent: Oct. 12, 1993

[54] COLLAPSIBLE SUITCASE

[76] Inventors: Daniel S. Cassese, 28 Elva Rd., No. Weymouth, Mass. 02191; George Spector, 233 Broadway-Room 702, New York, N.Y. 10279

[21] Appl. No.: 924,283

[22] Filed: Aug. 3, 1992

[51] Int. Cl.[5] ..... A45C 7/00; A45C 13/04; A45C 13/34

[52] U.S. Cl. ..... 190/107; 190/103

[58] Field of Search ..... 190/103-105, 190/107, 127, 14, 15 R, 21, 22, 903; 383/2

[56] References Cited

U.S. PATENT DOCUMENTS

| | | | |
|---|---|---|---|
| 1,001,563 | 8/1911 | Spiro | 190/127 |
| 1,019,547 | 3/1912 | Spiro | 190/127 |
| 1,241,210 | 9/1917 | Harvey | 190/104 |
| 2,016,520 | 10/1935 | Short | 190/107 X |
| 2,019,636 | 11/1935 | Scrantom | 190/107 |
| 2,538,616 | 1/1951 | Cross | 190/107 |
| 2,710,084 | 6/1955 | Braverman | 190/107 |
| 2,718,943 | 9/1955 | Braverman | 190/107 |
| 2,806,563 | 9/1957 | Einhorn | 190/107 |
| 4,160,496 | 7/1979 | Knight | 190/107 |
| 4,953,673 | 9/1990 | Ambasz | 190/107 X |

FOREIGN PATENT DOCUMENTS

| | | | |
|---|---|---|---|
| 725576 | 5/1932 | France | 190/103 |
| 60886 | 5/1912 | Switzerland | 190/14 |
| 261923 | 12/1926 | United Kingdom | 190/103 |
| 284003 | 1/1928 | United Kingdom | 190/21 |
| 727879 | 4/1955 | United Kingdom | 190/107 |
| 779784 | 7/1957 | United Kingdom | 190/107 |

*Primary Examiner*—Sue A. Weaver

[57] ABSTRACT

A collapsible suitcase is provided which consists of a housing having a top portion, a bottom portion and a peripheral accordion wall thereabout. A mechanism within the housing can be manipulated, for supporting the housing in an expanded condition for use and in a compressed condition for storage.

5 Claims, 2 Drawing Sheets

COLLAPSIBLE SUITCASE

BACKGROUND OF THE INVENTION

The instant invention relates generally to baggage and more specifically it relates to a collapsible suitcase which provides a structure which when in a compressed condition will need less space for storage when not in use.

There are available various conventional baggage which do not provide the novel improvements of the invention herein disclosed.

SUMMARY OF THE INVENTION

A primary object of the present invention is to provide a collapsible suitcase that will overcome the shortcomings of the prior art devices.

Another object is to provide a collapsible suitcase that contains a brace mechanism therein that can be manipulated to support the suitcase in its expanded condition for use and to a position of non-support whereby the suitcase can be collasped for storage.

An additional object is to provide a collapsible suitcase in which the sides are fabricated out of an accordion type flexible material, so that when in its compressed condition it will need less space for storage when not in use.

A further object is to provide a collapsible suitcase that is simple and easy to use.

A still further object is to provide a collapsible suitcase that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
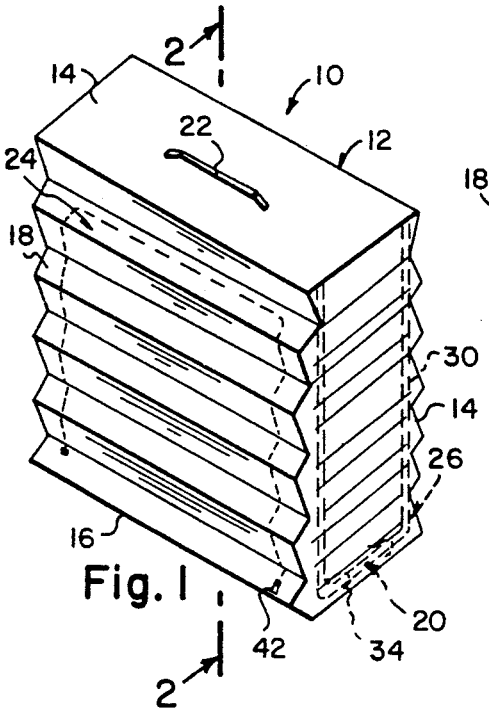
FIG. 1 is a diagrammatic perspective view of the instant invention.

Turning now descriptively to the drawings, in which similar reference characters denote similar elements throughout the several views, the Figures illustrate a collapsible suitcase 10 which consists of a housing 12 having a top portion 14, a bottom portion 16 and a peripheral accordion wall 18 thereabout. A mechanism 20 within the housing 12 can be manipulated, for supporting the housing 12 in an expanded condition for use to a position of non support whereby the suitcase can be collasped for storage.

A handle 22 is affixed to an upper surface of the top portion 14 of the housing 12 for carrying the collapsible suitcase 10. A closure member 24 is in the housing 12, so as to gain access into the housing 12. The supporting mechanism 20 is a pair of brace members 26, each located at opposite ends within the housing 12 and hinged at 28 to a lower surface of the top portion 14 of the housing 12.

Figure 2:
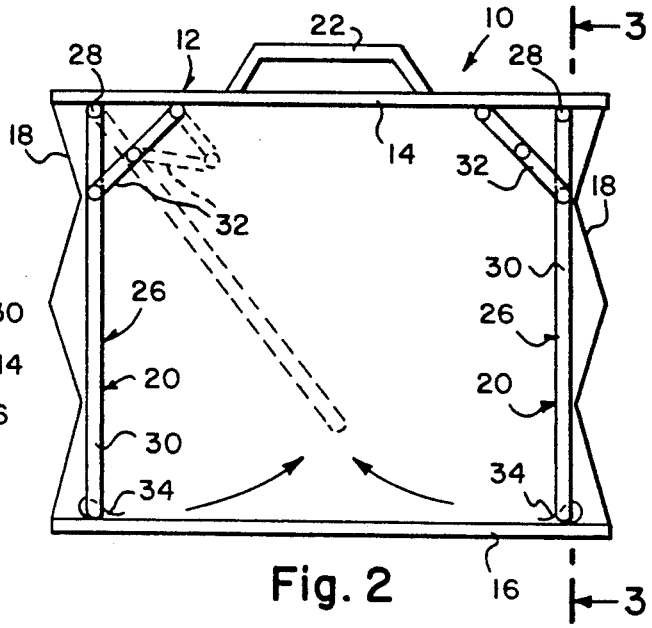
FIG. 2 is a diagrammatic cross sectional view taken along line 2—2 in FIG. 1.
Figure 3:
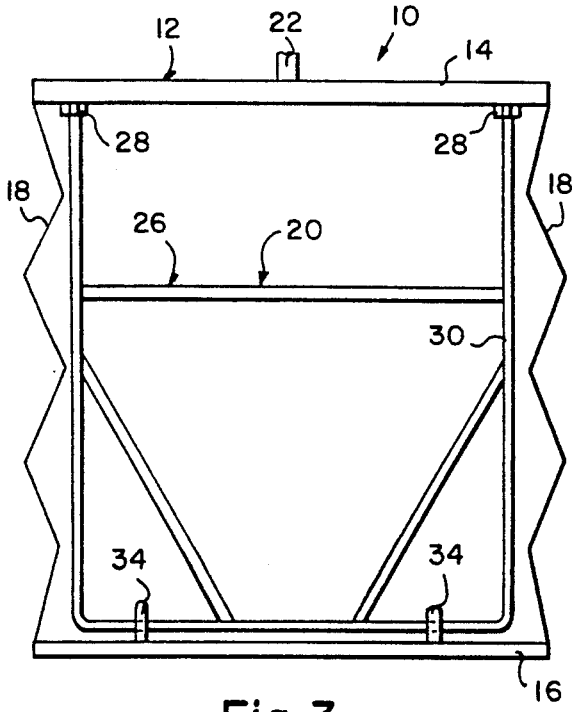
FIG. 3 is a diagrammatic cross sectional view taken along line 3—3 in FIG. 2.

As best seen in FIGS. 2 and 3, each brace member 26 consists of a U-shaped leg 30 and a pair of foldable braces 32. Each foldable brace 32 is angularly hinged between an upper portion of the U-shaped leg 30 and the lower surface of the top portion 14 of the housing 12. At least two fastener clamps 34 are each mounted oppositely to the upper surface of the bottom portion 16 of the housing 12 to engage with a lower portion of one U-shaped leg 30.

Figure 4:
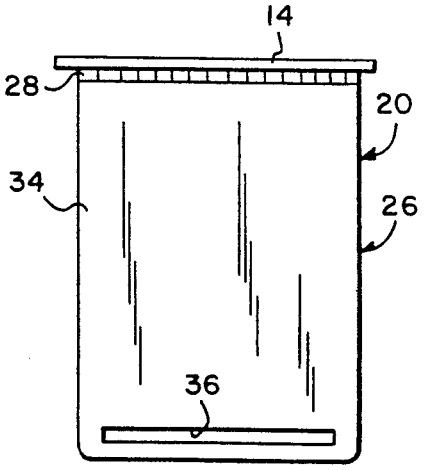
FIG. 4 is an end view showing another type of brace member.
Figure 5:
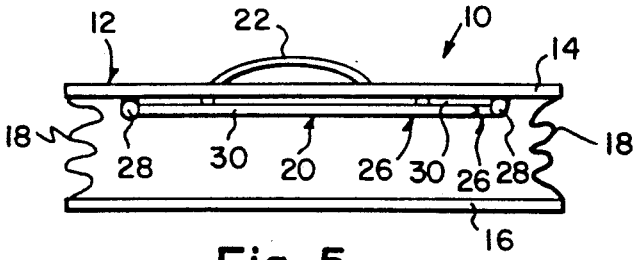
FIG. 5 is a diagrammatic cross sectional view similar to FIG. 2 showing the instant invention in a collapsed position.
Figure 8:
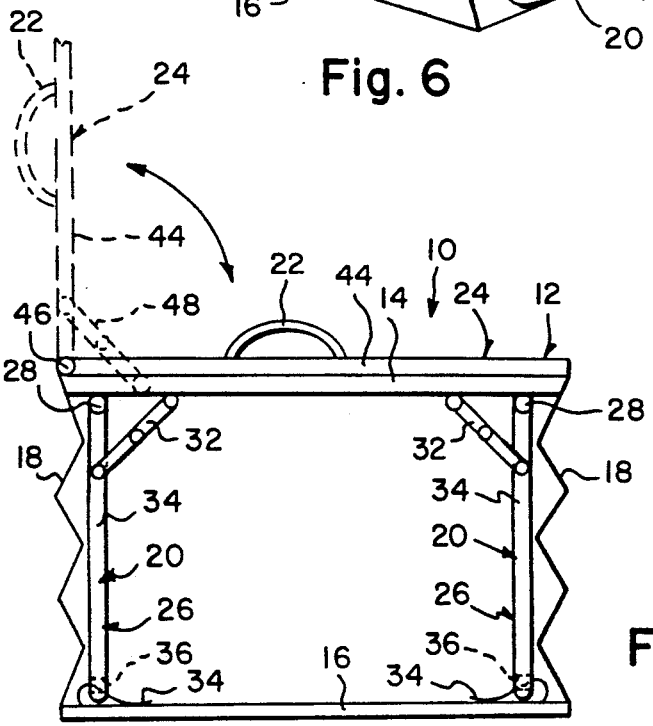
FIG. 8 is a diagrammatic cross sectional view similar to FIG. 2 showing another modification having a top hinged closure member instead of the side closure member for access into the housing.

As best seen in FIGS. 4 and 8, each brace member 26'' consists of a flat plate leg 34' having a horizontal slot 36 located at a lower portion thereof. The pair of foldable braces 32 are also utilized, with each angularly hinged between an upper side of the flat plate leg 34' and the lower surface of the top portion 14 of the housing 12. The at least two fastener clamps 34 are also each mounted oppositely to the upper surface of the bottom portion 16 of the housing 12 to engage with the horizontal slot 36 of one flat plate leg 34'.

Figure 7:
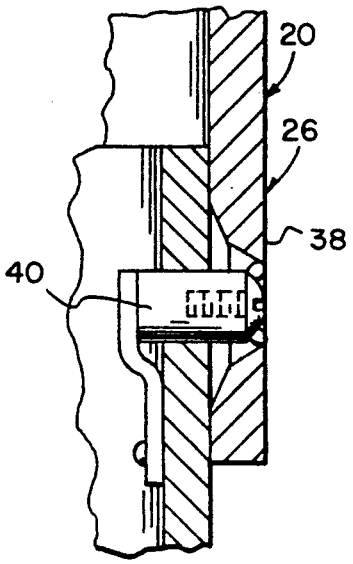
FIG. 7 is an enlarged cross sectional view taken along line 7—7 in FIG. 6 showing a retainer mechanism in one of the telescopic leg supports.
Figure 6:
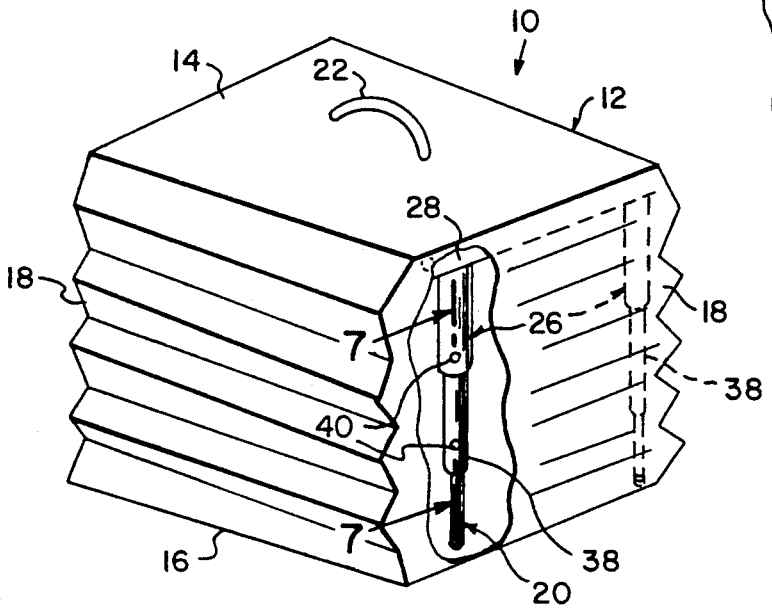
FIG. 6 is a diagrammatic perspective view with parts broken away showing a modification having telescopic leg supports.

Each brace member 26' can be a pair of spaced apart telescopic leg supports 38, as shown in FIGS. 6 and 7. Each telescopic leg support 38 includes a plurality of retainer mechanisms 40 for keeping the telescopic leg support 38 in an extended position.

As best seen in FIG. 1, the closure member 24 is formed in one side of the accordion wall 18 and is opened and closed by a slide operated fastener 42. The closure member 24' in FIG. 8, is a lid 44 formed from the top portion 14 of the housing 12 and is hinged at one end 46 thereof, so it can be opened and closed. A foldable brace 48 is angularly hinged between a side of the lid 44 adjacent the hinged end 46 and the top portion 14.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A collapsible suitcase which comprises:

a) a housing having a top portion, a bottom portion and a peripheral accordion wall thereabout;

b) means within said housing that can be manipulated to a position for supporting said housing in an expanded condition and to a position of non support whereby the suitcase can be collapsed for storage;

c) a handle affixed to an upper surface of said top portion of said housing; for carrying said collapsible suitcase;

d) a closure member in said housing, so as to gain access into said housing; wherein said supporting means is a pair of brace members, each located at opposite ends within said housing including hinges attaching said brace members to a lower surface of said top portion of said housing; wherein each said brace member includes:

e) a U-shaped leg; and f) a pair of foldable braces with ends, each hinged to said leg and said lower surface wherein each brace is foldable between said ends.

2. A collapsible suitcase as recited in claim 1, further including at least two fastener clamps, each mounted oppositely to the upper surface of said bottom portion of said housing to engage with a lower portion of one said U-shaped leg.

3. A collapsible suitcase which comprises:

a) a housing having a top portion, a bottom portion and a peripheral accordion wall thereabout;

b) means within said housing that can be manipulated to a position for supporting said housing in an expanded condition and to a position of non support whereby the suitcase can be collapsed for storage;

c) a handle affixed to an upper surface of said top portion of said housing, for carrying said collapsible suitcase;

d) a closure member in said housing, so as to gain access into said housing; wherein each said means for supporting includes:

e) a flat plate leg having a horizontal slot located at a lower portion thereof; and f) a pair of foldable braces, each angularly hinged between an upper side of said flat plate leg and the lower surface of said top portion of said housing.

4. A collapsible suitcase as recited in claim 3, further including at least two fastener clamps, each mounted oppositely to the upper surface of said bottom portion of said housing to engage with the horizontal slot of one said flat plate leg.

5. A collapsible suitcase which comprises:

a) a housing having a top portion, a bottom portion and a peripheral accordion wall thereabout;

b) means within said housing that can be manipulated, to a position for supporting said housing in an expanded condition and to a position of non support whereby the suitcase can be collapsed for storage;

c) a handle affixed to an upper surface of said top portion of said housing, for carrying said collapsible suitcase;

d) a closure member in said housing, so that as to gain access into said housing; wherein said supporting means is a pair of brace members, each located at opposite ends within said housing including hinges attaching said brace members to a lower surface of said top portion of said housing; wherein said closure member is formed in one side of said accordion wall and is opened and closed by a slide operated fastener.

* * * * *